United States Patent [19]

Harnish

[11] Patent Number: 4,563,877

[45] Date of Patent: Jan. 14, 1986

[54] CONTROL SYSTEM AND METHOD FOR DEFROSTING THE OUTDOOR COIL OF A HEAT PUMP

[75] Inventor: James R. Harnish, York, Pa.

[73] Assignee: Borg-Warner Corporation, Chicago, Ill.

[21] Appl. No.: 619,957

[22] Filed: Jun. 12, 1984

[51] Int. Cl.[4] ..... F25D 21/06

[52] U.S. Cl. ..... 62/80; 62/156

[58] Field of Search ..... 62/156, 155, 151, 140, 62/128, 80

[56] References Cited

U.S. PATENT DOCUMENTS

| | | | |
|---|---|---|---|
| 4,298,947 | 11/1981 | Tamura et al. | 374/170 |
| 4,302,947 | 12/1981 | Mueller et al. | 62/155 |
| 4,328,680 | 5/1982 | Stamp et al. | 62/155 |
| 4,338,790 | 7/1982 | Saunders et al. | 62/80 |
| 4,373,349 | 2/1983 | Mueller | 62/156 |
| 4,417,452 | 11/1983 | Ruminsky et al. | 62/155 |

FOREIGN PATENT DOCUMENTS

| | | | |
|---|---|---|---|
| 0018248 | 2/1981 | Japan | 62/156 |
| 0219345 | 12/1983 | Japan | 62/155 |

*Primary Examiner*—Harry Tanner

*Attorney, Agent, or Firm*—James E. Tracy

[57] ABSTRACT

The current outdoor ambient temperature and outdoor coil temperature in a heat pump are sensed when the heat pump's outdoor coil is clean and frost-free, and from those current temperatures the split or difference that will later exist between the temperatures, when sufficient frost has built up on the outdoor coil to necessitate defrosting, may be determined. When that defrost temperature split, called the Defrost Value or DV, is reached, defrost is initiated and the frost that has accumulated on the coil is melted. Before defrost occurs, however, changing weather conditions (namely, changing outdoor temperature and/or changing outdoor relative humidity) may effectively invalidate the previously determined defrost temperature split or DV, and a frost condition may be reached at a substantially different temperature split, either greater or smaller than that previously calculated. To ensure that the heat pump is switched to a defrost mode only and always when defrost is needed, the defrost control system continually monitors the outdoor ambient and outdoor coil temperatures and from those temperatures any significant weather condition change may be detected and a new defrost temperature split, that will exist when defrosting becomes necessary under the new weather conditions, will be calculated from the sensed temperatures. When the new defrost temperature split or DV is attained, defrost takes place. Hence, the temperature differential, where defrosting will be required, is effectively updated or adjusted between defrost modes in response to changing weather conditions, thereby optimizing the efficiency of the heat pump and conserving energy.

16 Claims, 3 Drawing Figures

CONTROL SYSTEM AND METHOD FOR DEFROSTING THE OUTDOOR COIL OF A HEAT PUMP

BACKGROUND OF THE INVENTION

This invention relates to a method and control for defrosting the outdoor coil of a heat pump in a manner which optimizes efficiency and conserves energy.

When a heat pump operates in its heating mode, frost builds up on the pump's outdoor coil. As the frost thickness increases, heat transfer from the outdoor air decreases and the efficiency of the heat pump drops significantly, a substantial amount of energy therefore being wasted. Hence, it is necessary to periodically defrost the outdoor coil. This is usually accomplished by reversing the refrigerant flow in the heat pump which will heat the outdoor coil and melt the frost.

It is recognized that there is an optimum point of frost accumulation at which the heat pump should be switched to its defrost mode of operation. If defrost is commanded too soon or too late, energy will be wasted and efficiency will suffer. Unfortunately, it has been very difficult to achieve such optimum operation in the past. Moreover, these previous defrost systems are unreliable in operation and/or are not adaptable to all types of outdoor coils.

Substantially less expensive defrost control systems have also been developed, but these systems are not capable of adjusting to the prevailing weather conditions. In one such system, the differential between the outdoor ambient (dry bulb) temperature and the refrigerant temperature in the outdoor coil is measured. The outdoor coil temperature decreases as frost builds up, and this increases the temperature split or difference between the outdoor ambient temperature and the coil temperature. When the temperature split increases to a predetermined value, the outdoor coil is defrosted. These prior temperature differential type defrost controls, however, fail to take the weather conditions into account. The temperature split between the outdoor ambient air (dry bulb) temperature and the refrigerant temperature in the outdoor coil for clean coil operation is a function of the outdoor wet bulb temperature and not the dry bulb temperature. For example, when the outdoor ambient air has a 35° F. dry bulb temperature, a 34° F. wet bulb temperature, and a relative humidity of about 90%, the refrigerant temperature in the outdoor coil of a typical three ton heat pump may be about 23° F. when the outdoor coil is frost-free, the clean coil temperature split (namely, the outdoor ambient temperature minus the outdoor coil temperature) thereby being 35°−23° or 12°. (All temperatures mentioned herein will be F or Fahrenheit.) For the same outdoor dry bulb temperature, an outdoor wet bulb temperature of 28° and an outdoor relative humidity of about 40% may then provide an outdoor coil temperature of about 17°, resulting in a clean coil temperature split of 35°−17° or 18°. Neither humidity condition is uncommon in most areas. Thus, if the defrost control were set, when the ambient air has a 34° wet bulb temperature, to initiate defrost at a temperature differential of, for example, 5° above its expected clean coil condition, defrost would occur when the temperature differential became 12°+5° or 17° and dry weather conditions would result in the system continually defrosting itself without time for frost buildup on the outdoor coil.

Even if the temperature split, at which defrost should occur, is properly determined when the outdoor coil is frost-free, long before frost builds up and that temperature split is reached the weather conditions (namely, the outdoor temperature and/or relative humidity) may change significantly, and that previously determined temperature split may no longer be appropriate or valid. If there is a decrease in outdoor temperature between defrost modes, excessive frost would build up on the outdoor coil and defrost should now be initiated at a smaller temperature split, not the one previously determined. On the other hand, as the outdoor temperature rises the same system may go into needless defrost because the control would assume that frost is building up on the coil, when it may not.

This phenomenon may be appreciated and more fully understood by observing FIG. 1 which provides a graph of the performance of the typical three ton heat pump mentioned previously. The graph plots the wet bulb temperature of the outdoor air versus the outdoor ambient or dry bulb temperature at different outdoor relative humidities. The graph shows the liquid line temperature, which is essentially the same as the outdoor coil temperature or the coil surface temperature, under clean coil conditions at various wet bulb temperatures. The clean coil temperature splits (the outdoor dry bulb temperature minus the liquid line temperature) for different weather conditions, namely at different points on the graph, may easily be determined by subtraction of one temperature from the other at the point that represents the weather conditions. The graph clearly illustrates that the liquid line temperature is strictly a function of the wet bulb temperature, and thus the moisture in the outdoor air.

It will be assumed that on a given day at about 7 a.m. the weather conditions in a particular area are as depicted by point 11 in FIG. 1, namely about 12° outdoor ambient temperature, 10.5° wet bulb temperature and about 77% relative humidity, the liquid line temperature for clean coil conditions thus being about 4.5° to provide a clean coil temperature split of 12°−4.5° or 7.5°. Point 12 indicates the assumed weather conditions on the same day at 10 a.m.—29° outdoor dry bulb temperature, 23° wet bulb temperature, about 40% relative humidity and a liquid line temperature of about 13.5°, the clean coil temperature split thereby being 29°−13.5° or 15.5°. This corresponds to an 8° increase (15.5−7.5) in the temperature split for a clean outdoor coil. If the control system were programmed, in accordance with the data at 7 a.m., to initiate defrost after there is a 4° temperature increase in the clean coil temperature split, a needless defrost cycle would occur with no frost build up on the outdoor coil. Points 13 and 14 in FIG. 1 depict the assumed weather conditions at 4 p.m. and 11 p.m., respectively, on the same given day. The graph indicates that the clean coil temperature split would change downward from about 18° to 11.5°, or about 6.5°, between 4 p.m. and 11 p.m. Thus, a 4° programmed differential would require that the initial 18° clean coil split at 4 p.m. would have to increase to 22° before defrost would occur, whereas the optimum defrost split (the difference between the outdoor temperature and the coil temperature when the defrost mode should be initiated) for the weather conditions at 11 p.m. would be 11.5° plus 4°, or 15.5°. Hence, the split would increase 6.5° (from 15.5° to 22°) above the optimum defrost condition before defrost would be initiated and excessive frost would accumulate. The conditions assumed in explaining the FIG. 1 graph are not uncommon, since the outdoor temperature and relative humidity may experience wide variations over a 24-hour period.

The defrost control system of the present invention is a substantial improvement over those previously developed. The system is not only relatively inexpensive but the initiation of outdoor coil defrost is timed to occur at the optimum point regardless of changing weather conditions so that defrost only and always occurs when it is necessary, thereby increasing the efficiency of the heat pump, conserving energy and improving system reliability. Any time there is a significant change in the weather conditions, the control system of the present invention will effectively recalculate when a defrost cycle should be initiated.

SUMMARY OF THE INVENTION

The invention provides a defrost control system for a heat pump having a compressor, an indoor coil, an outdoor coil in thermal communication with outdoor ambient air, and a reversing valve for reversing refrigerant flow between the two coils to switch the operation of the heat pump from a heating mode to a defrost mode to defrost the outdoor coil. The control system comprises a first temperature sensor for sensing the temperature of the outdoor ambient air, and a second temperature sensor for sensing the temperature of the outdoor coil. Control means are provided for determining, from the currently sensed temperatures under clean outdoor coil conditions, a Defrost Value, or defrost temperature split, which is the difference that will later exist between the two sensed temperatures under frosted coil conditions when defrosting will be necessary. Defrost means, controlled by the control means, establishes the heat pump in its defrost mode to defrost the outdoor coil when the Defrost Value is reached by the sensed temperatures. After the Defrost Value has been determined under clean coil conditions but before defrosting occurs, the control means responds to the sensed temperature of the outdoor ambient air and the sensed temperature of the outdoor coil to recalculate the Defrost Value any time there is a predetermined change in weather conditions, which change will be reflected by the sensed temperatures, thereby effectively updating and adjusting the Defrost Value between defrost modes as weather conditions vary so that defrost will occur only and always when it is necessary and the efficiency of the heat pump will be optimized.

DESCRIPTION OF THE DRAWINGS ILLUSTRATING THE INVENTION

The features of the invention which are believed to be novel are set forth with particularity in the appended claims. The invention may best be understood, however, by reference to the following description in conjunction with the accompanying drawings in which:

FIG. 1 is a graph of the performance of a typical three ton heat pump;

FIG. 2 schematically illustrates a heat pump having a defrost control system, for the heat pump's outdoor coil, constructed in accordance with one embodiment of the invention; and FIG. 3 is a program flow chart illustrating the logic sequence or routine of operations and decisions which occur in operating the defrost control system.

DESCRIPTION OF THE ILLUSTRATED EMBODIMENT

Figure 2:
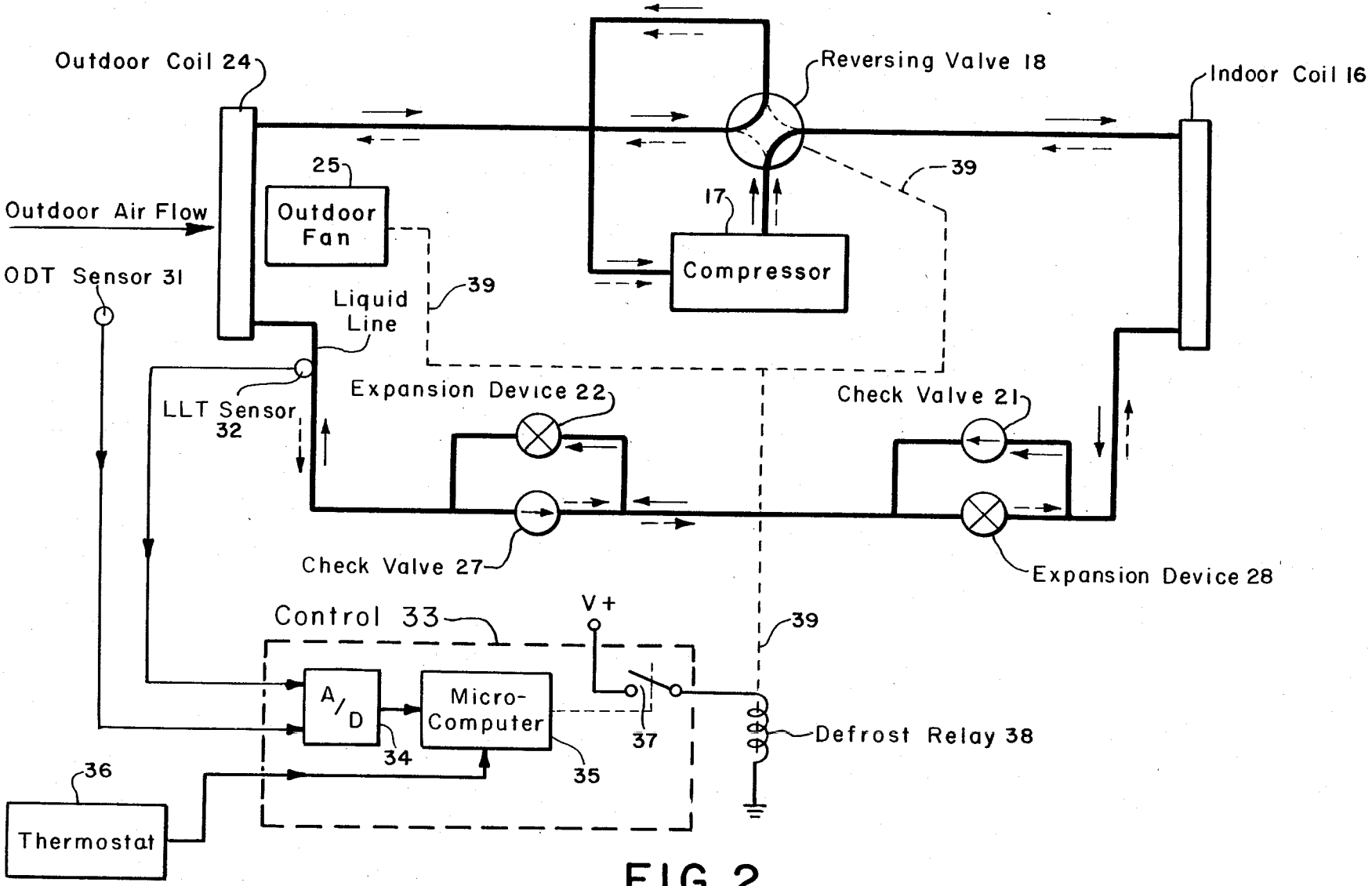

FIG. 2 depicts the major components of a typical heat pump for either heating or cooling an enclosed space as heat is pumped into or abstracted from an indoor coil 16. When the heat pump is in its heating mode, refrigerant flows through the refrigeration circuit in the direction indicated by the solid line arrows. The flow direction reverses when the pump is established in its cooling or air conditioning mode, as illustrated by the dashed line arrows. Refrigerant vapor is compressed in compressor 17 and delivered from its discharge outlet to a reversing valve 18 which, in its solid line position, indicates the heating mode. In that mode, the compressed vapor flows to the indoor coil 16, which functions as a condenser, where the vapor is condensed to reject heat into the enclosed space by circulating room air through the indoor coil by means of an indoor fan (not shown). The liquid refrigerant then flows through check valve 21, which would be in its full-flow position, expansion device 22 and the liquid line to the outdoor coil 24 which serves as an evaporator during the heating mode. The refrigerant absorbs heat from the air flowing through the outdoor coil, the outdoor air being pulled through the coil by outdoor fan 25. Any time the heat pump is in its heating mode, fan 25 will be turned on. After exiting the outdoor coil 24, the refrigerant passes through reversing valve 18 to the suction inlet of compressor 17 to complete the circuit.

In the cooling mode, the reversing valve 18 is moved to its dashed line position so that the refrigerant vapor compressed in compressor 17 flows to the outdoor coil 24 where it condenses to transfer heat to the outdoors. The liquid refrigerant then flows through the liquid line, check valve 27 and expansion device 28 to the indoor coil 16 which now functions as an evaporator. Heat is abstracted from the indoor air, causing the refrigerant to vaporize. The vapor then flows through the reversing valve 18 to the suction inlet of the compressor 17.

The components described above are well-known and understood in the art. The present invention is particularly directed to a control system for the heat pump arrangement, especially to a control system whose operation is controlled, in part, by data sensors. To this end, a first temperature sensor 31, which may be a thermistor, is positoned close to the outdoor coil 24 to sense the ambient temperature of the outdoor air or atmosphere. For convenience, it may be called the outdoor temperature or ODT sensor. A second temperature sensor 32, which can also be a thermistor, is positioned immediately adjacent to the liquid line in order to sense the temperature of the refrigerant liquid in the line. Since this liquid line temperature is essentially the same as the refrigerant temperature in the outdoor coil, or coil surface temperature, the liquid line temperature or LLT sensor 32 will monitor the outdoor coil temperature.

Sensors 31 and 32 are coupled to a control 33 which comprises an analog-to-digital converter 34 and a microcomputer 35 which may, for example, take the form of a 6805R2 microcomputer manufactured by Motorola. Such a microcomputer may easily be programmed to perform the logic sequence depicted by the flow chart of FIG. 3. Control 33 also receives an input from the thermostat 36 which controls the operation of the heat pump in conventional fashion. As will be made apparent, the input from thermostat 36 provides the microcomputer 35 with information relative to the operation of the heat pump. The control 33 also comprises a pair of normally-open contacts 37 which are controlled by the microcomputer 35. When contacts 37 are closed defrost relay 38 is energized.

The dashed construction lines 39 schematically illustrate that the defrost relay 38 controls the positioning of reversing valve 18 and the energization of outdoor fan 25. When the relay is de-energized, the reversing valve and the outdoor fan will be controlled and operated in conventional manner. On the other hand, when relay 38 is energized the heat pump is switched to its defrost mode, reversing valve 18 being positioned to its dashed line, or cooling mode, position and outdoor fan 25 being turned off. In this way, the hot refrigerant gas from the compressor 17 will be delivered to the outdoor coil 24 to melt any frost on the coil. By turning fan 25 off, the outdoor air flow across the coil is eliminated, reducing the heat transfer from the coil to the outside air to a very low level. The heat therefore builds up within the coil itself and rapidly defrosts the coil.

Figure 3:
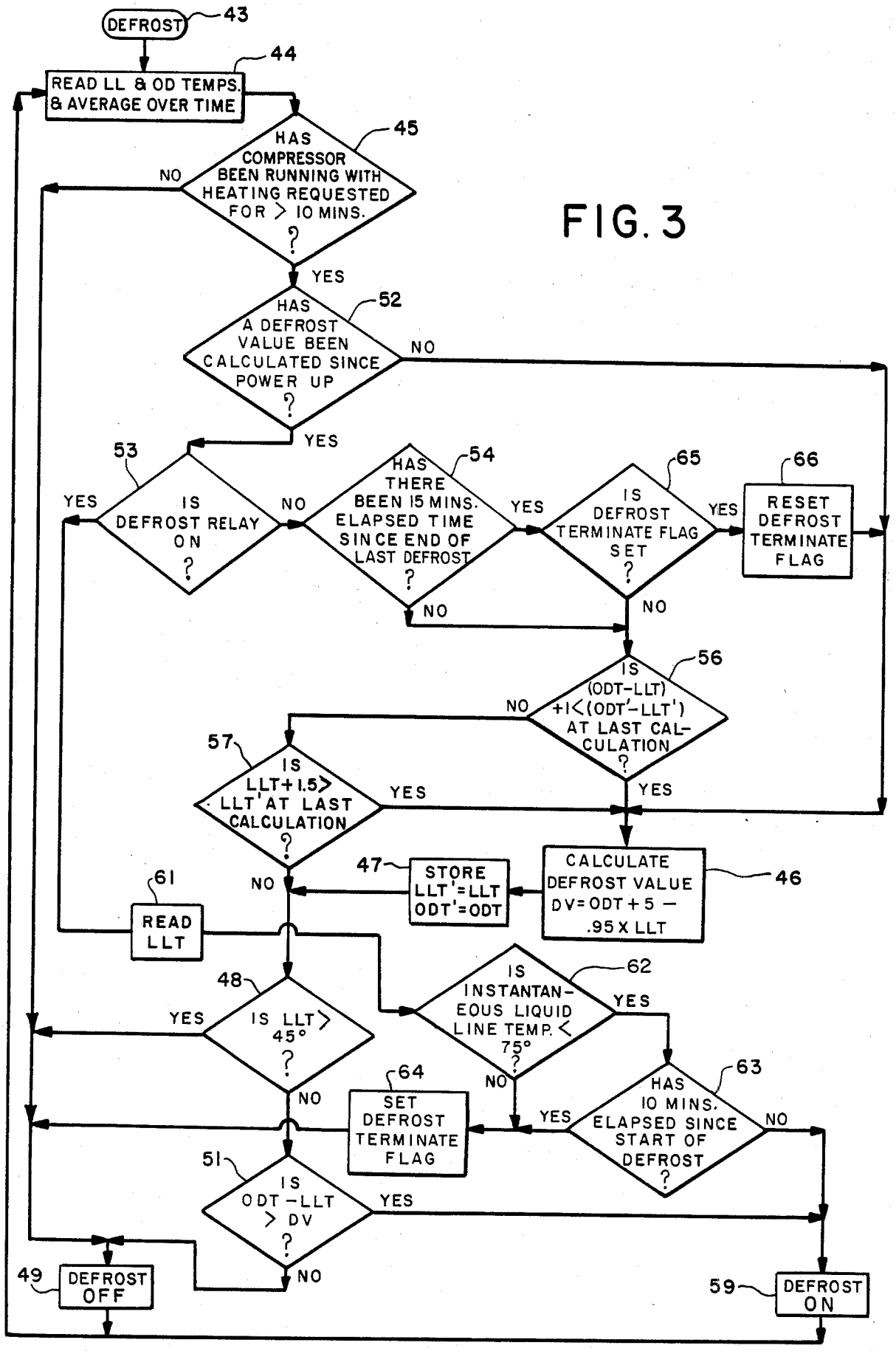

In short, microcomputer 35 will be operated, in accordance with the logic sequence of FIG. 3, in order to precisely time the opening and closing of contacts 37 in response to the prevailing weather conditions so that defrost occurs only when it is necessary, thereby precluding needless defrosts or excessive frost build up.

Consideration will now be given to an explanation of the operation of the defrost control system. Referring to FIG. 3, the oval, labeled "Defrost" and identified by the reference number 43, indicates the entry point into the logic flow chart or into the routine. This is the point where entry must be made in order to eventually determine whether or not defrost should occur. In accordance with operation or instruction block 44 the computer will initially read the liquid line (LL) and outdoor ambient (OD) temperatures and average or integrate those temperatures over a period of time, preferably about one minute. This step removes any short term fluctuations in the temperatures. Thus, this elminates the effects of wind gusts that may give momentary changes. The liquid line temperature (LLT) and the outdoor temperature (ODT) will be continuously averaged over a minute so that any time the temperatures LLT and ODT are used in the logic sequence (with the exception of one operation and one decision that will be explained), the temperatures will be average temperatures.

Decision block 45 indicates that a determination will now be made as to whether the compressor 17 has been running with heating being requested for at least a preset time period, for example, for at least ten minutes, following power up. Preferably, the microcomputer 35 is continuously powered at all times, even when thermostat 36 is not calling for heat and the heat pump is inoperative. Power up would include not only when the control system is initially turned on but also after every power outage including brown-outs and momentary power interruptions. Any time there is a power loss, either purposely or accidentally, any stored information in the memory banks of the microcomputer will be lost or erased. The determination made by decision block 45 is accomplished by sensing the input to the microcomputer 35 from thermostat 36 which will indicate whether the thermostat has been calling for heat, and the compressor has been operating, for at least ten minutes. Assuming that the control system has in fact just powered up and the compressor 17 has just started operating, the NO exit of block 45 will be taken and operation block 49 will be entered which thereupon issues a defrost off instruction for effectively maintaining contacts 37 open so that defrosting will not occur. Of course, when contacts 37 are already open, a defrost off instruction is redundant. Either a defrost off or a defrost on instruction is always issued before the routine is exited and re-entered at block 44 to start another logic sequence. Thus, during the first ten minutes of compressor operation after the control system has been powered up, the routine will continue to cycle through the logic sequence comprising only blocks 44, 45 and 49.

At the end of the ten minute interval, the YES exit of block 45 will be followed and decision block 52 will be entered to inquire whether a Defrost Value or DV has been calculated since power up. The Defrost Value is calculated under clean coil conditions (namely, no frost buildup on outdoor coil 24) from the present or current liquid line and outdoor temperatures and is the temperature split that will later occur between those two temperatures under frosted coil conditions when defrosting will become necessary. When the control system is powered up and the compressor operates for only ten minutes, it will be assumed that clean coil conditions exist. Hence, it is appropriate to calculate a Defrost Value or defrost temperature split. Since the calculation will be made based on the current liquid line temperature (LLT) and outdoor temperature (ODT), the calculation effectively assumes that the prevailing weather conditions will remain substantially unchanged until the Defrost Value is attained and defrosting occurs.

Figure 1:
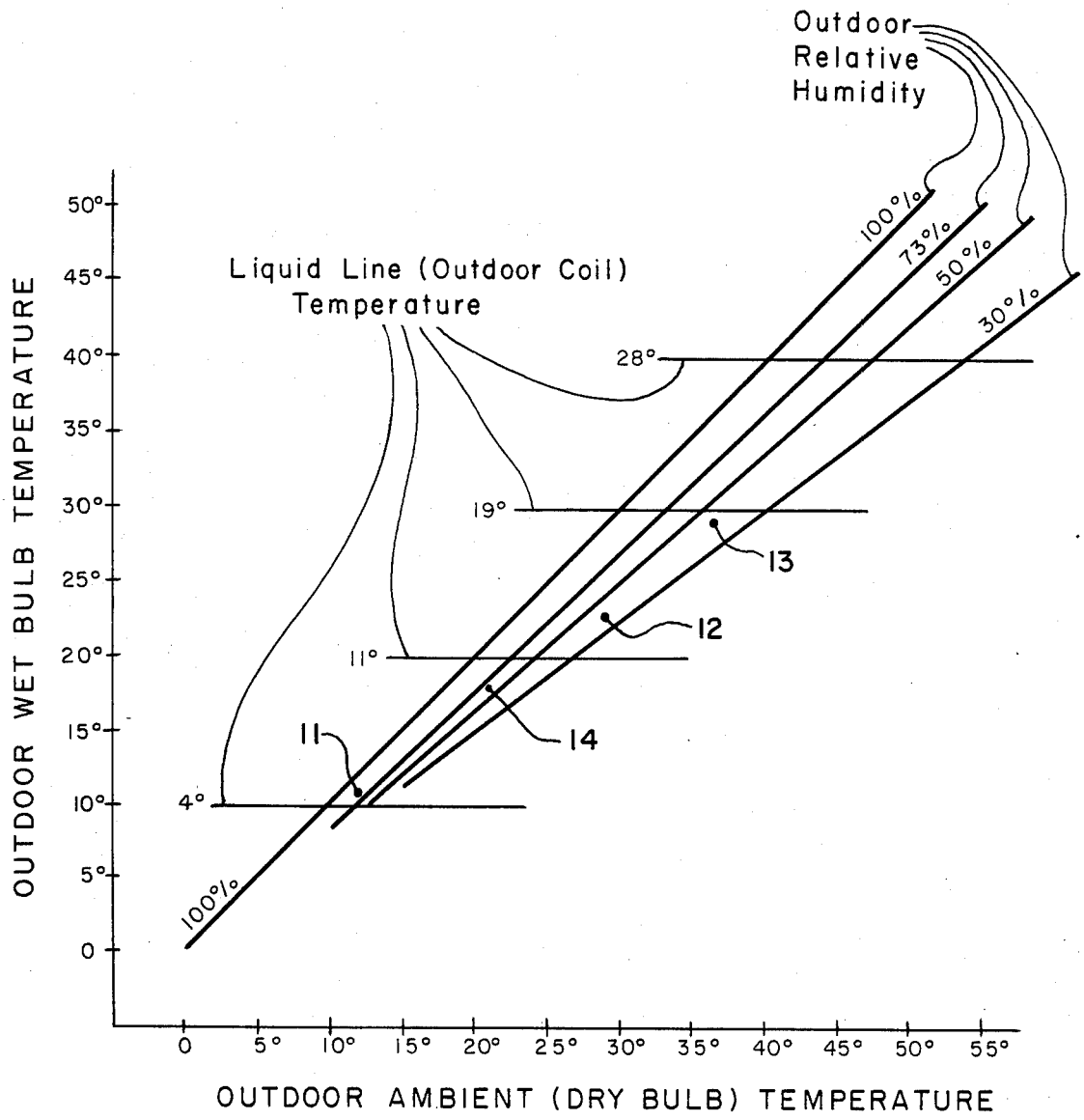

Since a Defrost Value has not been determined since power up, the NO exit of decision block 52 will be followed to operation or instruction block 46, whereupon a Defrost Value or DV is calculated in accordance with the equation: $DV=ODT+5-0.95\times LLT$. This equation was determined empirically for a particular unit. The constants of the equation may vary depending on unit design. It was found that for any weather condition when the temperature split or difference (ODT minus LLT), at clean coil conditions, increases to the DV as frost accumulates (remembering that the LLT decreases as frost builds up), at that optimum point sufficient frost will exist to require defrosting. Defrosting before or after that optimum point is reached would be inefficient and wasteful of energy. For example, if the LLT is 10° and the ODT is 25° when the coil is frost-free, the clean coil temperature split will be 15° for the heat pump whose performance curves are shown in FIG. 1. If a DV is calculated, based on those clean coil conditions, the DV will equal $25+5-0.95$ (10) or 20.5°. This means that at a later time, after frost has accumulated on the outdoor coil and defrosting is needed, the temperature split between ODT and LLT will be 20.5°. If the ODT does not change during that time, the LLT, when the defrost temperature split is reached, will be 25°−20.5° or 4.5°.

After the Defrost Value is determined, the LLT and ODT used in the calculation, which will be temperatures averaged over about one minute, will be stored, as indicated by operation block 47, as LLT′ and ODT′. Decision or inquiry block 48 is then entered to determine if the present or current LLT is greater than 45°. If the LLT is above that temperature level, defrosting will not be needed and operation block 49 will be entered which thereupon issues a defrost off instruction for effectively maintaining contacts 37 open so that defrosting will not occur.

If it is found (inquiry block 48) that the LLT is below 45°, then a decision is made in block 51 as to whether ODT−LLT (the current outdoor temperature minus the current liquid line temperature) is greater than the DV that was previously calculated. Of course, since the DV has just been determined, the ODT and LLT will be the same as when the calculation was made so the answer from inquiry block 51 will be NO and a defrost off instruction will be produced by block 49.

After the calculation of the DV, or defrost temperature split, has been made, the YES exit of block 52 is taken and decision or inquiry block 53 is entered to inquire whether defrost relay 38 is on or energized, namely, whether the heat pump is already in the defrost mode. This logic step is needed during defrost, as will be explained later. In effect, block 53 determines whether the system is already in the defrost mode. During defrosting, the microcomputer continuously cycles through its routine and, if thermostat 36 continuously calls for heat, blocks 45 and 52 will continue issuing YES answers throughout the defrost mode as well as the heating mode.

Since the system has recently powered up and the DV has been calculated, there has been insufficient time for frost to build up so that the defrost relay will be off and decision block 54 will be entered, from the NO exit of block 53, to determine if there has been at least fifteen minutes of elapsed time since the end of the last defrost. At this time the control system will show no previous defrost, since at power up there is no stored information or history relative to a previous defrost. Hence, the NO exit of inquiry block 54 will be taken to the block 56 which effectively decides whether the present temperature difference between the outdoor temperature and the liquid line temperature plus 1° is less than the old difference at the calculation time. Block 56 inquires whether the ODT minus the LLT plus 1° is smaller than the ODT′ minus the LLT′, ODT′ and LLT′ being the values of the outdoor and liquid line temperatures used in calculating the DV and stored at the time of the calculation. In this way, block 56 determines if the current ODT−LLT temperature split is decreasing by at least 1° from when the DV was calculated. The inclusion of block 56 in the routine compensates for a change in weather conditions where the outdoor temperature is decreasing.

Since the control system has only been operating about ten minutes since power up, weather conditions probably have not changed sufficiently to produce a YES in block 56, so the NO exit of that block will be taken to block 57 which determines if the present liquid line temperature has increased by at least 1.5° from the liquid line temperature stored at the calculation of the DV. An increasing LLT indicates that weather conditions have changed, since normally as frost builds up on the outdoor coil the LLT decreases. By detecting a significant increase in the LLT, the control system will compensate for an increase in the outdoor wet bulb temperature. Once again, inasmuch as the system has been functioning only about ten minutes following power up, the weather conditions probably have not changed enough to result in a YES answer from block 57, the NO exit thus being taken to block 48. From that block, block 51 is entered and exited to the defrost off block 49. Hence, during this period following power up the routine will continue to cycle through the logic sequence comprising only blocks 44, 45, 52, 53, 54, 56, 57, 48, 51 and 49.

Assume now that the prevailing weather conditions are relatively constant and that the heat pump has been operating for a relatively long period. During this time NO answers will be issued by blocks 56 and 57 indicating that there is no reason to recalculate the DV and the DV determined ten minutes after power up will continue to be effective. Assume also that during this long time period sufficient frost has built up on the outdoor coil 24 to cause the liquid line temperature to drop to the extent that the current temperature split between the ODT and the LLT exceeds the Defrost Value previously calculated. As a consequence, when the routine enters block 51 a YES answer will now be issued for the first time and this causes operation block 59 to close contacts 37 and energize defrost relay 38. Reversing valve 18 will thereupon be operated to reverse the refrigerant flow between coils 16 and 24 and to establish the heat pump in its cooling mode, the coils thus being reversed in temperature. At the same time, outdoor fan 25 is turned off to concentrate the heat at the surface of outdoor coil 24 to rapidly melt the frost thereon. Since the indoor air will be cooled by coil 16 during the defrost mode of operation, a heater of some type (for example, an electric heater) may be turned on to warm the indoor air while the outdoor coil is being defrosted. To this end, defrost relay 38 may also control a set of contacts for energizing the heater. Alternatively, a separate relay, controlled by contacts 37, may be provided for controlling the heater.

While the heat pump is in its defrost mode, the microcomputer 35 continues to cycle through its program. At this time, however, decision block 53 will issue a YES answer and instruction block 61 will read the current instantaneous liquid line temperature. This is the only step in the logic sequence where the instantaneous liquid line temperature is used. In every other instance, the LLT is the current temperature averaged over one minute. The instantaneous LLT is needed because the temperature, along with the head pressure in the outdoor coil, rise very rapidly at the end of the defrost cycle and unless the temperature is monitored very closely and limited, the head pressure could exceed the level at which the compressor's high pressure cut off would open and the compressor would be turned off, thus shutting down the heat pump. Decision block 62 then responds to the present instantaneous liquid line temperature and if it is greater than 75° the NO exit of block 62 will be used, a defrost terminate flag will be set (block 64), and the defrost relay 38 will be turned off through block 49 to terminate defrost. When the LLT reaches 75° the outdoor coil 24 will have been defrosted. Even if the outdoor ambient temperature is extremely cold, for example 5°, the outdoor coil temperature will still increase to 75° because there is no air flow over the outdoor coil at that time and heat will be built up within the coil itself. At 75°, the frost is quickly removed.

If during defrost block 62 finds that the instantaneous LLT is below 75°, defrost continues and the YES exit of that block is followed to decision block 63 which determines if ten minutes has elapsed since defrost started. If not, defrost continues, but if the answer is YES, defrost is terminated and the defrost terminate flag is set in block 64. Defrost will not be allowed to occur for more than ten minutes. If the LLT does not go to 75° in ten minutes, the wind is probably blowing so hard across the outdoor coil that the wind functions like a fan and keeps the LLT from rising to 75°. In any event, however, adequate defrosting will occur in ten minutes even though the 75° temperature is not attained.

After defrost is terminated and the heat pump is switched back to its heating mode, for the next fifteen minutes the microcomputer will cycle through the routine comprising blocks 44, 45, 52, 53, 54, 56, 57, 48, 51 and 49, assuming, of course, that the weather conditions have not changed since the DV was calculated previous to the defrost. Until a new DV is calculated, the old one will not be erased and will still be effective even though a defrost has occurred. In other words, once an initial DV has been calculated after power up, there will always be a DV stored in the control system. The stored DV is not erased until a new DV is calculated. Fifteen minutes of waiting time was selected because that amount of time may be required to stabilize the conditions after the termination of defrost. It may take that long for the indoor and outdoor coil temperatures to reach stable conditions. Since the coils are reversed in temperature during the defrost mode, it takes a substantial period of time to revert the coils back to their original temperatures after defrost is concluded. Minimum frost will accumulate on the outdoor coil during that fifteen minute interval so clean coil conditions will exist at the end of the interval.

After fifteen minutes has elapsed since the end of the defrost, the routine will change and the YES exit of block 54 will be used. Decision block 65 will thus be entered for the first time since power up in order to determine whether a DV has been calculated since the last defrost by checking to see if the defrost terminate flag had been set by block 64. Block 65 is included in the program to ensure that a DV will be calculated fifteen minutes after defrost and under clean outdoor coil conditions. Since the defrost terminate flag is set, the YES exit of block 65 will be taken to block 66, to reset the defrost terminate flag, and to block 46 to initiate the calculation of a new DV based on the weather conditions prevailing at the time of the calculation, those weather conditions being reflected by the current LLT and ODT. According to block 47, the LLT and ODT used in calculating the new DV will be stored as LLT′ and ODT′, respectively, for later use.

The new DV has now been established and until there is a substantial weather change the microcomputer will cycle through the routine comprising blocks 44, 45, 52, 53, 54, 65, 56, 57, 48, 51 and 49. Assume now that before frost accumulates on coil 24, and causes the DV to be reached, there is a significant change in the weather conditions, such as a decrease in the outdoor wet bulb temperature such that the current temperature split between ODT and LLT decreases by at least 1° from the temperature split (ODT′−LLT′) that existed at the time the calculation of the DV was made. In this event, block 56 will answer YES when it is interrogated and this causes block 46 to recalculate the DV based on the ODT and LLT prevailing at that time. The new DV would now be smaller and this will essentially eliminate the problem of excessive frost build up on the outdoor coil when the change in weather conditions results in a defrost temperature split smaller than what was determined after the last defrost cycle In other words, if the DV was not recalculated and the control system waited for the old DV to be reached, by that time excessive frost would have accumulated on the outdoor coil.

On the other hand, if the changing weather conditions (increasing outdoor wet bulb temperature) cause the LLT to increase by at least 1.5° from its value when the DV was calculated, the YES exit of block 57 will be taken to block 46 to initiate a recalculation of the DV based on the new weather conditions. A larger DV thus results, overcoming the problem of needless defrost cycles when no frost has accumulated on the outdoor coil, which problem could otherwise occur when changing weather conditions causes a larger defrost temperature split than what was calculated after the last defrost. If the DV was not recalculated and defrost occurred as soon as the old DV was reached, there would be either no frost or insufficient frost on the outdoor coil to warrant defrost Hence, in accordance with a salient feature of the invention, the DV is effectively updated and adjusted between defrost modes as weather conditions vary so that defrost will occur only and always when it is needed, the efficiency of the heat pump thereby being optimized.

Although the outdoor coil temperature, or liquid line temperature, is used to determine when defrost should be initiated, any temperature related to the coil temperature could be used instead. For example, the temperature of the air leaving the outdoor coil 24 could be used since it is a function of the coil temperature. The same results would be achieved. As in the case of the liquid line temperature, the leaving air temperature will be lower than the outdoor ambient temperature, and as frost builds up on the outdoor coil the leaving air temperature will decrease because the air flow will be restricted by the frost. This provides the same type of indication when defrost should be initiated as is obtained when the LLT is measured. Thus, the air temperature range in the outdoor coil (namely, the temperature split or difference between the outdoor temperature and the temperature of the air after it has passed through the outdoor coil) could be used to determine when a defrost cycle should be initiated. Of course, a slightly different equation than that used in the illustrated embodiment for calculating the Defrost Value would be needed, although the equation form would be the same. Actually, only the constants in the equation would have to be changed.

To explain further, fifteen minutes after the termination of defrost and under clean coil conditions the temperature range through the outdoor coil may be 6°. This temperature range would be stored in a memory bank and whenever the temperature range climbed to, for example, 9° (which would be the Defrost Value) a defrost cycle would be initiated. The same concept, for updating the DV, could be employed to correct for changes in weather conditions. In other words, for a drop in outdoor ambient temperature, a reduced temperature range would replace that previously stored in the memory bank. For an increase in outdoor temperature an increased temperature range would replace the one originally stored.

It should also be recognized that while the illustrated defrost control is microcomputer based, the invention could be implemented instead with other integrated circuits or even with discrete components.

The invention provides, therefore, a unique and relatively inexpensive temperature differential defrost initiation control for the outdoor coil of a heat pump wherein the stabilized clean coil temperature differential, after defrost, is used to establish a defrost temperature split, or Defrost Value, at which defrost will become necessary. If the weather conditions do not vary while the heat pump is operating and frost is building up on the outdoor coil, the Defrost Value will remain constant until it is reached and a defrost cycle is initiated. On the other hand, however, if the outdoor temperature and/or outdoor relative humidity change, those changing weather conditions will be detected and a new Defrost Value will be calculated based on the new weather conditions, as a result of which defrost occurs precisely when it is necessary.

While a particular embodiment of the invention has been shown and described, modifications may be made, and it is intended in the appended claims to cover all such modifications as may fall within the true spirit and scope of the invention.

I claim:

1. In a heat pump having an outdoor coil through which refrigerant flows and absorbs heat from outdoor ambient air, a defrost control system for the outdoor coil comprising:

a first temperature sensor for sensing the outdoor ambient temperature;

a second temperature sensor for sensing a temperature which is related to the temperature of the outdoor coil;

control means responsive to said first and second temperature sensors under clean coil conditions for determining a Defrost Value which is the difference that will exist between the two sensed temperatures under frosted coil conditions when defrosting will be required;

and defrost means, controlled by said control means, for defrosting the outdoor coil when the Defrost Value is reached, said control means functioning, before defrosting occurs, to recalculate the Defrost Value any time there is a predetermined change in sensed temperatures, which will be the result of changes in weather conditions.

2. In a heat pump having a compressor, an indoor coil, and an outdoor coil in thermal communication with outdoor ambient air, and which heat pump may be switched from a heating mode to a defrost mode to defrost the outdoor coil, a defrost control system for the outdoor coil comprising:

a first temperature sensor for sensing the temperature of the outdoor ambient air;

a second temperature sensor for sensing a temperature which is related to the outdoor coil temperature;

control means responsive to said first and second temperature sensors for determining, from the currently sensed temperatures under clean outdoor coil conditions, a Defrost Value which is the difference that will later exist between the two sensed temperatures under frosted coil conditions when defrosting will be necessary;

and defrost means, controlled by said control means, for establishing the heat pump in its defrost mode to defrost the outdoor coil when the Defrost Value is reached by the sensed temperatures, said control means responding to the two sensed temperatures and functioning, after the Defrost Value has been determined under clean coil conditions but before defrosting occurs, to recalculate the Defrost Value any time there is a predetermined change in sensed temperatures, which will be the result of changes in weather conditions, thereby effectively updating and adjusting the Defrost Value between defrost modes as weather conditions vary so that defrost will occur only and always when it is needed and the efficiency of the heat pump will be optimized.

3. A defrost control system according to claim 2 wherein an initial Defrost Value is calculated after the defrost control system has been powered up and after the compressor has been running, with heating requested, for at least a preset time period following power up of the control system.

4. A defrost control system according to claim 2 wherein, after the outdoor coil has been defrosted, a new Defrost Value, based on the current outdoor ambient temperature and outdoor coil temperature, is not calculated until a given time interval has elapsed since the end of defrost.

5. A defrost control system according to claim 2 wherein the sensed temperatures are averaged over a given time interval before the defrost control system responds to those temperatures.

6. A defrost control system according to claim 2 wherein once a defrost mode has been initiated, the mode will be terminated when the temperature of the outdoor coil increases to a given value.

7. A defrost control system according to claim 2 wherein once a defrost mode has been initiated, the mode will be terminated when a preset time period has elapsed since the start of defrost.

8. A defrost control system according to claim 2 for use in a heat pump where the refrigerant flows, during the heating mode, to the outdoor coil through the heat pump's liquid line, said second temperature sensor sensing the refrigerant temperature in the liquid line, which liquid line temperature is essentially the same as the outdoor coil temperature.

9. A defrost control system according to claim 8 wherein the Defrost Value is calculated by adding $k_1$ to the current outdoor temperature and then subtracting, from the sum, the product of $k_2$ and the current liquid line temperature, where $k_1$ and $k_2$ are constants.

10. A defrost control system according to claim 2 wherein after a Defrost Value has been calculated, and before defrosting occurs, a recalculation is subsequently made if the difference between the current outdoor ambiient temperature and outdoor coil temperature decreases by a predetermined amount from the difference between those temperatures existing at the time of the last calculation.

11. A defrost control system according to claim 2 wherein after a Defrost Value has been calculated, and before defrosting occurs, a recalculation is subsequently made if the current outdoor coil temperature increases by a predetermined amount from the outdoor coil temperature existing at the time of the last calculation.

12. A defrost control system according to claim 2 wherein a defrost operating mode cannot be initiated if the outdoor coil temperature is above a preselected level.

13. A defrost control system according to claim 2 wherein once a defrost mode has been initiated, the mode will be terminated when the instantaneous outdoor coil temperature increases to a given value.

14. A defrost control system according to claim 2 for use in a heat pump having a reversing valve for reversing refrigerant flow between the indoor and outdoor coils to switch the operation of the heat pump from a heating mode to a defrost mode, the reversing valve being controlled by said defrost means.

15. In a heat pump having an outdoor coil through which refrigerant flows and absorbs heat from outdoor ambient air which flows across the outdoor coil, a defrost control system for the outdoor coil comprising:

a first temperature sensor for sensing the outdoor ambient air temperature;

a second temperature sensor for sensing the temperature of the air leaving the outdoor coil;

control means responsive to said first and second temperature sensors under clean coil conditions for determining a Defrost Value which is the difference that will exist between the two sensed temperatures under frosted coil conditions when defrosting will be required;

and defrost means, controlled by said control means, for defrosting the outdoor coil when the Defrost Value is reached, said control means functioning, before defrosting occurs, to recalculate the Defrost Value any time there is a predetermined change in sensed temperatures, which will be the result of changes in weather conditions.

16. In a heat pump having a compressor, an indoor coil, and an outdoor coil in thermal communication with outdoor ambient air, a method for defrosting the outdoor coil to melt the frost accumulated thereon during operation of the heat pump in its heating mode, comprising the steps of:

sensing the temperature of the outdoor ambient air;

sensing the temperature of the outdoor coil;

initially determining, from the two sensed temperatures under clean outdoor coil conditions when the coil is devoid of frost, an initial Defrost Value which is the difference that will later exist between the two sensed temperatures under frosted conditions when defrosting is necessary;

before the initial Defrost Value is reached, continually updating and adjusting the Defrost Value, based on the current outdoor air and outdoor coil temperatures, in the event that weather conditions change by a predetermined extent;

and defrosting the outdoor coil when the Defrost Value is attained by the two sensed temperatures.

* * * * *